US008937235B2

(12) United States Patent
Rawson

(10) Patent No.: US 8,937,235 B2
(45) Date of Patent: Jan. 20, 2015

(54) PROFESSIONAL UPRIGHT PIANO ACTION

(71) Applicant: Christopher Richard Rawson, Plattsburgh, NY (US)

(72) Inventor: Christopher Richard Rawson, Plattsburgh, NY (US)

( * ) Notice: Subject to any disclaimer, the term of this patent is extended or adjusted under 35 U.S.C. 154(b) by 0 days.

(21) Appl. No.: 13/867,073

(22) Filed: Apr. 20, 2013

(65) Prior Publication Data

US 2014/0311314 A1 Oct. 23, 2014

Related U.S. Application Data

(60) Provisional application No. 61/687,228, filed on Apr. 20, 2012.

(51) Int. Cl.
*G10C 3/18* (2006.01)
*G10C 3/16* (2006.01)

(52) U.S. Cl.
CPC ..... *G10C 3/161* (2013.01)
USPC ..... 84/240

(58) Field of Classification Search
USPC ..... 84/240
See application file for complete search history.

(56) References Cited

U.S. PATENT DOCUMENTS

| | | | | | |
|---|---|---|---|---|---|
| 364,399 | A | * | 6/1887 | Dopp | 84/240 |
| 450,694 | A | * | 4/1891 | Guild | 84/240 |
| 693,131 | A | * | 2/1902 | Hamilton | 84/240 |
| 786,407 | A | * | 4/1905 | Brewer | 84/240 |
| 1,121,517 | A | * | 12/1914 | Lyon | 84/240 |
| 1,125,304 | A | * | 1/1915 | Gilmore | 84/240 |
| 1,586,547 | A | | 6/1927 | Eastman | |
| 1,823,142 | A | | 9/1931 | Hickman | |
| 1,866,152 | A | | 7/1932 | Cameron | |
| 1,900,488 | A | | 3/1933 | Dasenbrook | |
| 1,999,914 | A | | 4/1935 | Nylund | |
| 2,061,154 | A | | 11/1936 | Heitzmann | |
| 2,116,117 | A | | 5/1938 | Homm | |
| 2,146,114 | A | | 2/1939 | Finholm | |
| 2,156,963 | A | * | 5/1939 | Betz | 84/240 |
| 2,166,396 | A | | 7/1939 | Dasenbrook | |
| 2,167,670 | A | * | 8/1939 | Morse | 84/240 |
| 2,226,877 | A | | 12/1940 | Schulze | |
| 2,266,690 | A | | 12/1941 | Martin | |
| 2,273,789 | A | | 2/1942 | Prevost | |
| 2,324,037 | A | | 7/1943 | Socin | |
| 2,329,009 | A | | 9/1943 | Socin | |
| 2,418,733 | A | * | 4/1947 | Sperry | 84/240 |
| 2,424,018 | A | * | 7/1947 | Brown | 84/240 |
| 2,425,989 | A | | 8/1947 | Brown | |
| 2,445,512 | A | | 7/1948 | Brown | |
| 2,468,132 | A | | 4/1949 | Stein | |
| 2,501,529 | A | | 4/1950 | Markley | |
| 2,524,835 | A | | 10/1950 | Ringholz | |
| 2,542,306 | A | | 2/1951 | Brown | |
| 2,542,309 | A | * | 2/1951 | Brown | 84/240 |
| 2,550,153 | A | | 4/1951 | Ketterman | |
| 2,657,608 | A | * | 11/1953 | Wolfe | 84/240 |
| 2,691,319 | A | * | 10/1954 | Waters | 84/240 |
| 2,715,850 | A | * | 8/1955 | Murdock | 84/236 |
| 2,767,608 | A | * | 10/1956 | Miessner | 84/236 |
| 2,800,827 | A | * | 7/1957 | Haselton | 84/404 |

(Continued)

*Primary Examiner* — Robert W Horn

(57) ABSTRACT

A vertical or upright piano action includes a key bed, a key frame, a wippen, a damper action, a hammer action, a repetition lever, a sustain mechanism, sostenuto mechanism, and an una chorda or action shift mechanism. Butt directly engages damper, improving response to professional standard. Touch resistance is unchanged by sustain mechanism.

7 Claims, 1 Drawing Sheet

(56) References Cited

U.S. PATENT DOCUMENTS

| | | | | | |
|---|---|---|---|---|---|
| 2,835,157 | A | | 5/1958 | Waters | |
| 3,048,074 | A | * | 8/1962 | Quednau | 84/240 |
| 3,076,371 | A | * | 2/1963 | Andersen | 84/240 |
| 3,106,861 | A | * | 10/1963 | Roehrig | 84/240 |
| 3,171,320 | A | * | 3/1965 | Underwood, Jr. | 84/240 |
| 3,651,732 | A | * | 3/1972 | Erbert et al. | 84/240 |
| 4,161,129 | A | | 7/1979 | Carbone | |
| 4,840,101 | A | | 6/1989 | Kumer | |
| 4,860,626 | A | | 8/1989 | Tanaka | |
| 4,879,939 | A | | 11/1989 | Wall | |
| 4,896,577 | A | | 1/1990 | Trivelas | |
| 5,042,354 | A | | 8/1991 | Trivelas et al. | |
| 5,123,321 | A | | 6/1992 | Caught | |
| 5,272,950 | A | | 12/1993 | Petersen | |
| 5,353,671 | A | | 10/1994 | Inoue et al. | |
| 5,511,454 | A | | 4/1996 | Jones et al. | |
| 7,129,403 | B2 | | 10/2006 | Wroblewski | |
| 7,476,788 | B2 | | 1/2009 | Yoshisue | |
| 7,678,977 | B2 | | 3/2010 | Yoshisue et al. | |
| 7,687,694 | B2 | | 3/2010 | Clark et al. | |
| 7,718,872 | B2 | | 5/2010 | Bafunno | |
| 7,985,907 | B2 | | 7/2011 | Inoue | |

* cited by examiner

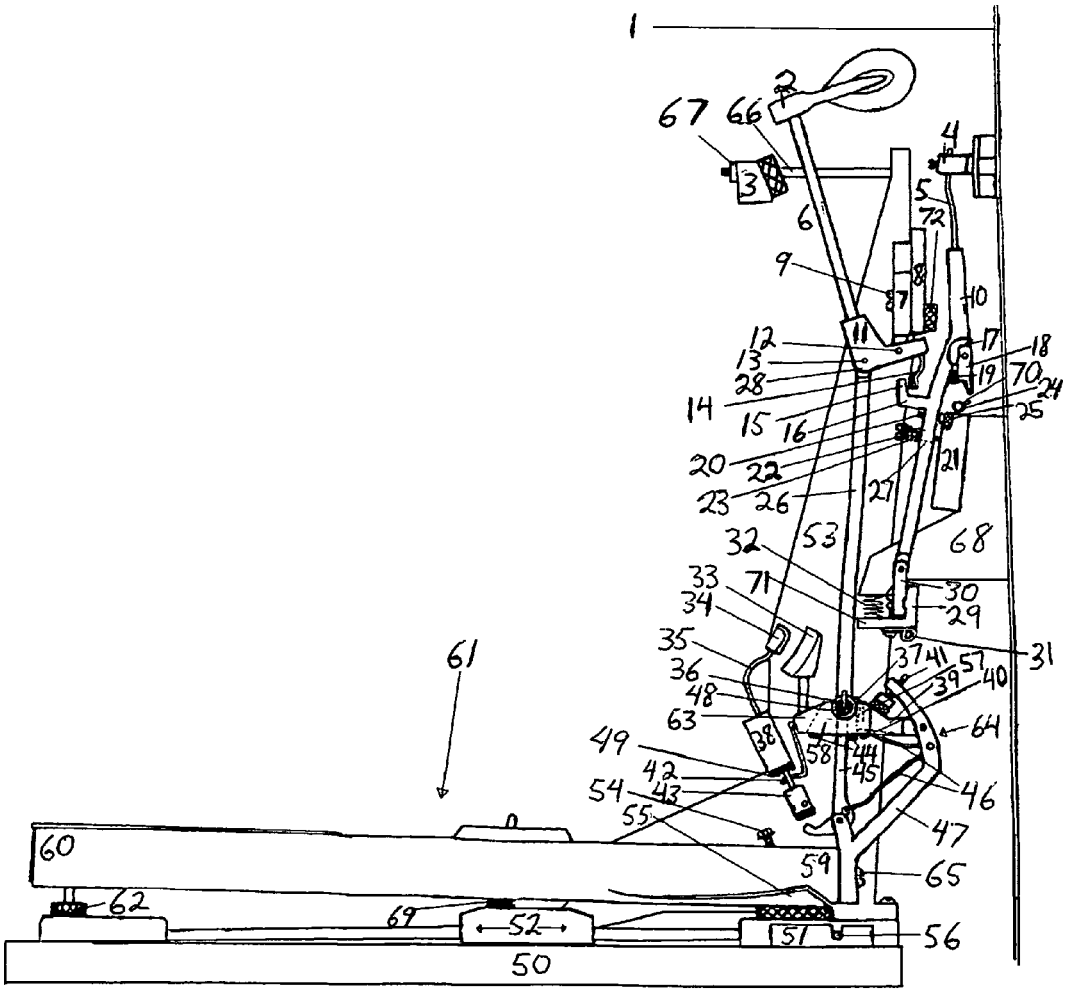
1
2
3
4
5
6
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57
58
59
60
61
62
63
64
65
66
67
68
69
70
71
72

PROFESSIONAL UPRIGHT PIANO ACTION

CROSS REFERENCE TO RELATED APPLICATIONS

This patent application claims the benefit of Provisional Patent Application No. 61/687,228 filed Apr. 20, 2012 entitled "Professional Vertical Piano Action".

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

For any pianist looking for a piano that has superior touch and tone, so as to be able to perform high level works, or perhaps moderate level works with greater ease and enjoyment, purchasing a grand piano of at least 6' in length has been the requirement, as these pianos have the length of string, and soundboard area sufficient to produce excellent tone. They also have a high response action mechanism. This responsiveness is enabled by a repetition lever, and the force of gravity on the hammers, which in a grand piano travel vertically to strike strings which are oriented horizontally.

Most musicians have neither the space nor the money to afford such an instrument. The next best option currently available is to purchase a tall upright piano because of its long string length and large soundboard size, however because the strings of this type of piano are oriented vertically, the hammers must travel horizontally, and be a significant distance above the keys in order to strike the strings in the correct location, often necessitating additional parts to span the gap between the key and wippen. One downside to the common upright action, is that to reset the action so that it can be struck again, it relies on the parts below the hammer butt to move back into position faster than the hammer does. For this reason, there is often a difference between the movement of the hammer and butt, and the lower parts of the action, causing unpredictability when playing difficult passages. In addition, because there is little spring force and dead weight pushing the keys back up from the fully depressed position, (compared to a grand piano action), the pianist must lift more on their fingers when playing quickly. To date, none have been very successful in producing vertical pianos that could solve these problems without high cost of production, or problems with serviceability.

FIELD OF THE INVENTION

This application generally relates to acoustic keyboard instruments such as a piano or harpsichord, the invention being designed mainly for vertically strung pianos to improve their performance without added cost, detriment to serviceability, or reliability.

BRIEF SUMMARY OF THE INVENTION

A vertical or upright piano action includes a key bed, a key frame, a wippen, a damper action, a hammer action, a rotating damper flange rail acting as the sustain mechanism, a sostenuto mechanism, and an una chorda or action shift capability. Hammer action directly engages damper action, and wippen includes a repetition lever, thus improving response to professional standard without incurring great cost, or using mechanisms abstruse to technicians. Touch resistance is unchanged by sustain mechanism, which is a feature never achieved in even the finest pianos produced today. Repetition lever has a channel to accept a knuckle, thus greatly reducing the knuckle rolling friction and wear normally seen in grand pianos. Hammer checking is governed by the repetition lever, allowing greater height of a vertically strung piano without added cost to the action or sacrifice in performance. Wippen is mounted directly to the key.

The layout of this action is such that the knuckle rotates far less than a traditional piano, upright or grand, in relation to the jack, allowing the pianist to enjoy a smoother feel than a typical grand. Also, unlike an upright piano, the jack remains in the same starting position until its rotation is initiated by the letoff screw, thus allowing the pianist to more accurately gauge the moment the jack disengages the knuckle, thereby having more control over the instrument.

BRIEF DESCRIPTION OF THE SEVERAL VIEWS OF THE DRAWING

The drawing included shows the invention as installed in a vertical piano, being viewed from the right side, so as to show all critical components.

DETAILED DESCRIPTION OF THE INVENTION

This invention comprises an action mechanism for a vertically strung piano, (or other vertically strung musical instrument), comprising a key bed 50, a key frame 52, and a plurality of piano keys 61, keys 61 being mounted side by side in ordinary fashion to key frame 52. A wippen 64 is affixed to the rear portion 59 of each key 61, each wippen 64 comprising a wippen body 47, an ordinary jack 45, an ordinary repetition spring 46, a repetition lever 39, and a repetition lever adjustment screw 41. Rear portion 59 of each key 61 has an adjustable height bottom surface 55, and an adjusting screw 54 which passes through key 61 to regulate the height of bottom surface 55. In the current embodiment, wippen 64 was secured to the back of key 61 using an ordinary flange screw 65.

Key frame 52 is made the same as ordinary grand pianos and can shift a short distance from side to side for musical effect. Key frame 52 has ordinary guide pins 56 mounted in each side to maintain front to rear position while shifting side to side. Guide pins 56 are installed near the rear portion 59 of key 61, and rest in grooved blocks 51 which are mounted to key bed 50 at both sides of key frame 52.

Repetition lever 39 comprises an ordinary check block 33 which is mounted atop the front portion 63 of repetition lever 39 facing the back catchers 34, a permanently mounted hammer drop adjustment wire 42, a vertical window 58, a 10 mm deep, 10 mm wide horizontal channel 48 running straight through when viewed from the side, an ordinary repetition spring receiving slot 40, and is attached to wippen body 47 in the same manner as ordinary repetition levers are attached to grand piano wippens. Vertical window 58 is of appropriate width and length to accommodate the required motion of jack 45 within, and has a vertical channel 57 approximately 3/16" wide and 1/8" deep which begins about 1/4" directly above the open end of repetition spring receiving slot 40, running straight upward with an open end at the top. Felts 44 are mounted at opposite ends of vertical window 58 to limit the motion of jack 45.

Said action mechanism further comprises a plurality of hammers 2 glued onto shanks 6 which are glued into butts 11 and arranged side by side in ordinary fashion. Each butt 11 comprises a flange joint 12, a sticker joint 13, and a felted extension 14 which reaches downward from flange joint 12 approximately 3/4" and facing vertical portion 15 of damper pickup finger 16. Each butt 11 is mounted to a hammer flange rail 8 via an ordinary flange 7 and screw 9. Butt flanges 7 are oriented vertically above flange joint 12. Stickers 26 are hinged on the heel 28 of butts 11 in the same manner stickers are ordinarily hinged to wippen heels in tall upright pianos. Each sticker 26 has an ordinary 10 mm knuckle 36 mounted to its base, and each knuckle 36 has a strip of leather 37 glued to the back which fits into vertical channel 57 in repetition lever 39. Hammer flange rail 8 is affixed to key frame 52 via a series of brackets 53 such as are standard in grand and upright pianos.

Said action mechanism further comprises a letoff rail 38, and hammer stop rail 3. Letoff rail 38 comprises a plurality of ordinary back catchers 34 mounted side by side into it via ordinary check wires 35. Letoff rail 38 further comprises a plurality of ordinary letoff buttons 43 oriented parallel to the travel of wippen 64. Letoff rail 38 is felted 39 on the underside. Hammer stop rail 3 is mounted to brackets 53 via a plurality of bolts 66 and nuts 67.

Said action mechanism further comprises a damper action. Said damper action comprises a plurality of damper levers 10 arranged side by side in an ordinary fashion, a damper flange rail 29, and a damper guide rail 21 to which each damper lever 10 is attached. Each damper lever 10 comprises an ordinary damper head 4 and mounting wire 5, an ordinary sostenuto tab 24 with spring 17 and stop felt 19, an engagement finger 16, a lift regulating screw 20 (same as an ordinary drop screw), a bushed hole 21 with an interior diameter of approximately 1/16"-1-8", and an ordinary flange 30 at its base.

Damper flange rail 21 is hinged 31, is mounted to the piano in the same way grand piano damper trays are commonly mounted, and is held in place by several springs 32 such as are commonly used to hold grand piano damper trays.

Damper guide rail 21 is fixed to the interior of the instrument via 2 to 5 brackets 68, and comprises a plurality of regulating screws 22 which pass through damper springs 23 and bushed holes 27 in each damper lever 10 to screw into damper guide rail 21. Damper guide rail 21 also comprises an ordinary sostenuto engagement rail 24, and a strip of damper guide felt 25 where lift regulating screws 20 will make contact.

This invention can easily be made using standard milling and molding equipment currently in use in factories. It can be made out of wood, metal, or composite materials. The structural components of the current embodiment were cut and shaped from wood, metal, leather, and other materials readily available from piano supply houses. The hammer flange rail 8, and damper flange rail 29 were made from Aluminum. The hammer stop rail 3, damper guide rail 21, and letoff rail 38 were made from maple timber. Anyone familiar with piano building, wishing to reproduce this action need only scale the drawing so that the action measures 16 3/8" tall from the bottom of rear corner of key 61 to the highest point on hammer 2. Drawing was taken from the actual blueprint from which the prototype was built.

The invention functions as a pianist applies downward force to key 61 at front portion 60, key 61 transferring upward force to wippen 64 which transfers upward force to knuckle 36 which transfers upward force through sticker 26 to butt 11 which rotates to apply forward force to hammer 2 through hammer shank 6. Pulling force is applied to damper lever 10 by butt 11 when it engages damper pickup finger 16 via felted extension 14. Butt 11 is positioned to engage damper lever 10 as hammer 2 reaches 1/3 to 1/2 its total traveling distance or the distance between the hammer 2 at rest, and string 1. (Hammer traveling distance of the current embodiment is 45 mm.) As hammer 2 nears contact with string 1, jack 45 comes in contact with letoff button 43 thereby rotating, and fully disengaging from knuckle 36 as hammer 2 reaches approximately 1 mm from string 1. Knuckle channel 48 retains knuckle 36 in proper forward position as jack 45 rotates out from under it. Knuckle 36 rotates in relation to knuckle channel 48 as key 61 pivots on balance punching 69. Knuckle 36 in channel 48 acts as a joint.

Strip of leather 37 retains knuckle 1 in correct side to side position in knuckle channel 48.

As hammer 2 reaches approximately 3 mm from string 1, hammer drop wire 42 contacts the felt 49 on the underside of letoff rail 38, preventing repetition lever 39 from further upward motion. At the same time, jack 45 begins to rotate, moving in relation to repetition lever 39 the same manner as a traditional grand piano jack and repetition lever. As the pianist continues to apply downward force, key 61 moves downward at the front 60 until stopping on front rail punching 62, which occurs immediately after jack 45 disengages from knuckle 36.

After jack 45 has disengaged from knuckle 36, hammer 2 continues on under its own momentum to contact string 1. Hammer 2 compresses slightly, then simultaneously repels string 1 into motion and repels itself backward. As hammer 2 moves away from string 1, (key 61 being fully depressed), check block 33 drops, being pushed downward by knuckle 36 via repetition lever 39, and is arrested by back catcher 34. As repetition lever 39 is arrested by back catcher 34 via check block 33, hammer 2 and damper lever 10 are also arrested, and remain stationary, with string 1 vibrating freely until key 1 is released. At this moment, hammer 2 is arrested at between 1/4"-1/2" away from string 1.

As force from the pianist is released, key 61 immediately moves upward at the front, its movement being initiated by spring force from catcher wire 35, hammer drop wire 42, and repetition spring 46 pushing against the resistance of damper spring 22, letoff rail 38, and the resting mass of hammer 2. As check block 33 is released, repetition lever 39 begins to move upward, simultaneously moving sticker 26 upward and key 61 upward at the front 60, thus quickly re-aligning jack 45 under knuckle 36 so that key can cause hammer 2 to strike string 1 again, long before key 61 returns to its rest position.

The rest position of repetition lever 39 is governed by repetition lever adjustment screw 41. If key 61 is not immediately re-depressed, key 61 will immediately return to its rest position. As key 61 returns to its rest position, damper spring 22 continues to apply backward force to hammer 2 via damper lever 10 until damper head 4 is resting on string 1 (or resting on damper guide felt 25 if damper flange rail 29 is engaged). As damper lever 10 reaches its rest position, hammer 2 and key 61, along with all adjoining parts, continue returning to their rest position under their own momentum and weight.

The keyboard shift feature or Una Chorda is controlled in exactly the same manner as is common in grand pianos, the current invention utilizing the same style of mechanism. When sostenuto rod 24 is engaged, it rotates so that the tangent 70 is vertical, thus holding up any damper levers 10 that were engaged when it was rotated. Sostenuto tabs 18 function in exactly the same fashion as the ones found in ordinary grand pianos.

Damper flange rail 29 is engaged by lever arm 71. When damper flange rail 29 is engaged, it rotates forward, causing each lift regulating screw 20 to contact damper guide felt 25, creating a pivot point, causing every damper head 4, (when properly adjusted), to simultaneously disengage from every string 1. When damper flange rail 29 is fully engaged, damper pickup finger 16 is the same distance away from felted extension 14 as when damper flange rail 29 is in its rest position. This is due to the fact that damper lever 10 moves forward slightly before lift regulating screw 20 contacts damper guide felt 25, and damper pickup finger 16 is positioned slightly above lift regulating screw 20. Thus it rotates back slightly to its previous position as damper lever 10 reaches its fully engaged position. This relationship allows resistance of touch to remain the same, whether or not dampers are engaged by damper flange rail 29 when key 61 is depressed.

Adjustment screw 54 is turnable for adjusting the rest position of hammer 2. Lift regulating screw 22 allows easy adjustment of a plurality of damper levers 10, (installed side by side), to lift simultaneously when damper flange rail 29 is engaged.

Damper up stop felt 72 is positioned to limit excess motion when damper lever 10 is engaged rapidly. Regulating screw 22 maintains damper lever 10 side to side alignment, and can be turned to adjust the spring 23 resistance of damper lever 10. Key frame 52 along with its attached hammer action, can be removed for maintenance by lifting it upward so that guide pins 56 clear the top of grooved blocks 51, then backing it out of the instrument. Grooved blocks 51 act to guide felted extension 14 up and over the tip 15 of damper pickup finger 16 during key frame 52 installation and removal.

The invention claimed is:

1. A keyboard musical instrument, having at least one key, a wippen, and a repetition lever, wherein said repetition lever is installed on said wippen, wherein said wippen is mounted exclusively to said key.

2. A keyboard musical instrument, said instrument comprising a hammer butt or flange, and a damper lever, wherein said damper lever is engaged by said butt.

3. A keyboard musical instrument comprising a key, a repetition lever, and a knuckle, wherein said repetition lever has at least one channel or groove for retaining position of said knuckle in relation to said repetition lever.

4. A keyboard musical instrument as recited in claim 1, wherein said repetition lever has a check block.

5. A keyboard musical instrument as recited in claim 2, wherein said hammer butt is directly manipulated by a sticker, wherein said sticker has a closed hinge.

6. A keyboard musical instrument as recited in claim 2, wherein said damper lever has an adjustable pivot point.

7. A keyboard musical instrument as recited in claim 2, further comprising a plurality of damper levers, an individual engagement mechanism, and a collective engagement mechanism, wherein said damper levers have a first point of engagement for individual engagement, wherein said damper levers have a second point of engagement for collective engagement, wherein said damper levers being engaged collectively by said second point of engagement, said first point of engagement remains stationary in relation to its engagement mechanism.

* * * * *